US010202224B2

(12) United States Patent
Painchaud

(10) Patent No.: US 10,202,224 B2
(45) Date of Patent: Feb. 12, 2019

(54) LIQUID DISPENSING NOZZLE AND DEVICE COMPRISING A CAP

(71) Applicant: Nemera La Verpillière S.A.S., La Verpilliere (FR)

(72) Inventor: Gaëtan Painchaud, Francheville (FR)

(73) Assignee: Nemera la Verpilliere (FR)

( * ) Notice: Subject to any disclaimer, the term of this patent is extended or adjusted under 35 U.S.C. 154(b) by 0 days.

(21) Appl. No.: 15/994,425

(22) Filed: May 31, 2018

(65) Prior Publication Data

US 2018/0346208 A1 Dec. 6, 2018

(30) Foreign Application Priority Data

May 31, 2017 (FR) ..... 17 54839

(51) Int. Cl.
*B65D 47/00* (2006.01)
*B65D 51/24* (2006.01)

(52) U.S. Cl.
CPC ..... *B65D 47/00* (2013.01); *B65D 51/24* (2013.01)

(58) Field of Classification Search
CPC .... B65D 47/00; B65D 47/18; B65D 47/2068; B65D 51/24; B65D 51/1616; B05B 11/04; B05B 11/02
USPC ..... 222/153.1, 153.01, 153.02; 220/254.2, 220/255, 255.11; 215/217–220
See application file for complete search history.

(56) References Cited

U.S. PATENT DOCUMENTS

| | | | | |
|---|---|---|---|---|
| 4,181,232 | A | 1/1980 | Bellamy et al. | |
| 6,085,920 | A * | 7/2000 | Moretti | B65D 41/34 215/220 |
| 8,857,638 | B2 * | 10/2014 | Brozell | B65D 50/041 215/219 |
| 9,592,934 | B2 * | 3/2017 | Painchaud | B05B 11/00 |
| 9,676,525 | B2 * | 6/2017 | Greiner-Perth | B65D 47/2068 |
| 2015/0166224 | A1 * | 6/2015 | Greiner-Perth | B65D 47/2068 222/153.06 |
| 2015/0166229 | A1 * | 6/2015 | Wochele | B65D 41/48 222/153.05 |

(Continued)

FOREIGN PATENT DOCUMENTS

| | | | |
|---|---|---|---|
| EP | 1262416 | A2 | 12/2002 |
| EP | 2687198 | A2 | 1/2014 |

(Continued)

*Primary Examiner* — Lien Ngo
(74) *Attorney, Agent, or Firm* — St. Onge Steward Johnston & Reens, LLC

(57) ABSTRACT

A liquid dispensing nozzle having an opening, a removable cap, a residual liquid evaporation path between the opening and the exterior of the nozzle, an element for blocking the evaporation path, mobile in the cap between a blocking position and a position opening the evaporation path, the cap including an exterior envelope and an interior envelope that are coaxial, and mobile relative to one another in an axial direction between: a storage configuration; a configuration for unscrewing the cap when a bearing force exerted on the cap has an intensity greater than a predetermined threshold; a safety configuration if a bearing force exerted on the cap has an intensity lower than the predetermined threshold or if no bearing force is exerted on the cap, the blocking element being configured to be driven by the movement of the exterior envelope to pass from the blocking position to the opening position.

15 Claims, 8 Drawing Sheets

(56) References Cited

U.S. PATENT DOCUMENTS

| | | | | |
|---|---|---|---|---|
| 2016/0167838 | A1* | 6/2016 | Dong | B65D 41/0492<br>220/255 |
| 2016/0311588 | A1* | 10/2016 | Wochele | A61J 1/067 |
| 2017/0129662 | A1* | 5/2017 | Decock | B05B 11/0032 |

FOREIGN PATENT DOCUMENTS

| | | | | |
|---|---|---|---|---|
| WO | 2013140069 | A1 | | 9/2013 |
| WO | 2015140473 | A1 | | 9/2015 |
| WO | WO 2016/204732 | | * | 12/2016 |

* cited by examiner

LIQUID DISPENSING NOZZLE AND DEVICE COMPRISING A CAP

FIELD OF THE INVENTION

The present invention concerns the technical field of dispensing liquids. It concerns in particular, but not exclusively, the field of dispensing liquids in the form of droplets or in the form of a spray, such as ophthalmic, nasal, buccal or auricular liquid.

BACKGROUND OF THE INVENTION

There has already been proposed in the document WO2013/140069 a liquid dispensing device comprising a reservoir and a dispensing nozzle provided with a removable cap. The cap described in the above document comprises two envelopes mobile relative to one another in order to be able to create an air passage allowing evaporation of residual liquid located at the level of the dispensing orifice. It is found that this cap is opened simply by unscrewing it, with the result that the liquid product contained in the reservoir becomes easily accessible via the dispensing nozzle. This presents a hazard for a young child who may, by manipulating the device, manage to open the cap and obtain access to the liquid product, which may cause them to become intoxicated.

A particular object of the invention is to remedy these drawbacks by providing a liquid dispensing nozzle and device that are safer.

SUMMARY OF THE INVENTION

To this end, the invention consists in a liquid dispensing nozzle comprising: a liquid dispensing opening, a removable cap designed to cover said opening when it is mounted on the nozzle, a residual liquid evaporation path disposed between the opening and the exterior of the nozzle when the removable cap is mounted on the nozzle, means for blocking the evaporation path, mobile in the cap between a blocking position and a position opening the evaporation path, the cap comprising an exterior envelope and an interior envelope that are coaxial, mounted to be mobile relative to one another in an axial direction (A) of the nozzle between a configuration before first use, termed a storage configuration, in which the blocking means are in the blocking position; a configuration for unscrewing the cap when a bearing force exerted on the cap has an intensity greater than a predetermined threshold, in which rotation in a first direction of the exterior envelope drives rotation of the interior envelope in the same first direction, so as to be able to unscrew the cap; a safety configuration if a bearing force exerted on the cap has an intensity lower than the predetermined threshold or if no bearing force is exerted on the cap, in which the exterior envelope is configured to freewheel relative to the interior envelope in the first direction, the safety configuration further corresponding to a configuration in which the blocking means are in the opening position, the blocking means being configured to be driven by the relative movement between the exterior envelope and the rest of the nozzle in order to pass from the blocking position to the opening position.

Thus there is proposed a nozzle in which the exterior envelope and the interior envelope are advantageously able to assume a configuration allowing air to pass between them, whilst offering improved safety. In fact, a sufficiently high bearing force on the exterior envelope is required to unscrew the cap. Unscrewing remains simple and intuitive for an adult whereas a child, who is not capable of turning while pressing or of pressing sufficiently firmly on the exterior envelope, will find itself only in the safety configuration of the cap and will not be able to unscrew it. Said bearing force exerted on the cap is preferably, but not exclusively, an axial bearing force. Moreover, when the cap is in the unscrewing configuration, the exterior envelope is driven in rotation in the first direction, which is preferably the anticlockwise direction, corresponding to the classic unscrewing direction. Thanks to the bearing force applied to the exterior envelope, the interior envelope is also driven to turn in the same direction, which allows unscrewing of the cap. Clearly the means for blocking the evaporation path, when in the blocking position, enable a nozzle to be provided that is fluid-tight prior to its first use. It is therefore possible to limit evaporation of the liquid contained in the nozzle during storage of the nozzle and contamination of the nozzle by dust or microorganisms during storage. After the first opening of the cap, that is to say when the cap is in a configuration other than the storage configuration, the blocking means pass to the position opening the evaporation path. Because of this, air is advantageously able to pass between the two envelopes and enable evaporation of the liquid via that evaporation path. This makes it possible to prevent liquid stagnating at the dispensing opening of the nozzle, and therefore the growth of bacteria. It will be noted that the blocking means remain in the opening position and the evaporation path remains operational in the safety configuration, and preferably also in the unscrewing configuration. In other words, the evaporation path is blocked or opened by the blocking means, which, once in the opening position, remain in that position permanently, without regard to the movement or the position of the exterior and interior envelopes.

By "the exterior envelope is configured to freewheel relative to the interior envelope in the first direction" is meant that the exterior envelope is able to turn freely relative to the interior envelope in that direction, without being obliged to rotate with the interior envelope. When the cap is in the safety configuration, the exterior envelope is therefore configured to be driven in rotation in the first direction by the user, whilst the interior envelope remains immobile on the dispensing nozzle. In other words, rotation in the first direction of the exterior envelope does not have the effect of generating rotation of the interior envelope in the first direction. By "axial direction of the nozzle" is preferably meant the direction defined by a geometrical axis of the nozzle.

The invention may further include one or more of the following features, separately or in combination.

The blocking means are arranged between the exterior envelope and the interior envelope, the blocking means and the interior envelope each having a sealing surface and the sealing surfaces being in fluid-tight contact with one another when the blocking means are in the blocking position. The blocking means are advantageously not accessible to the user, which makes it possible to guarantee opening of the evaporation path when the nozzle is no longer in the storage configuration. In particular, the blocking means are covered by the exterior envelope.

The blocking means pass from the blocking position to the opening position by movement of the blocking means relative to the interior envelope in the axial direction (A). The passage from one position to the other can therefore be brought about simply by moving the blocking means in axial translation, or by a combination of movement in translation and rotation.

The blocking means pass from the blocking position to the opening position by rotation of the blocking means relative to the interior envelope in the first direction. An advantage of passage from one position to the other by rotation resides in the fact that the nozzle is particularly compact, very particularly in the axial direction (A). The movement of the blocking means may in particular be driven by that of the exterior envelope throughout the first opening of the cap before arriving at the opening position in which the blocking means are permanently fastened to the exterior envelope or the interior envelope. In particular this enables a reduction of noise between the components and improved evaporation of the residual liquid product.

The interior envelope comprises at least one air passage orifice, that air passage orifice being blocked by the blocking means when in the blocking position. For example the blocking means are assembled to the interior envelope by a tight fit of the blocking means on the interior envelope or by clipping of the blocking means to the interior envelope. This enables satisfactory hermetic sealing of the nozzle in the storage configuration.

The blocking means comprise at least one air passage orifice that is positioned facing the air passage orifice of the interior envelope only when the blocking means are in the opening position. This enables improved circulation of air via the evaporation path, because there is therefore created a very large air passage channel delimited by the superposed air passage orifices on the interior envelope and on the blocking means, which makes it possible for more air to circulate than if the channel is delimited by spaces between the components rather than specific orifices.

The exterior envelope comprises a screwing projection cooperating in a configuration for screwing on the cap with a screwing abutment carried by the interior envelope so that the interior envelope and the exterior envelope are connected in a rotation movement in a second direction opposite the first direction, in the safety configuration, with a sliding surface carried by the interior envelope, so that rotation of the exterior envelope in the first direction generates sliding of the screwing projection on the sliding surface so as to turn freely relative to the interior envelope.

Thus with this arrangement screwing and the safety configuration of the cap employ the same element of the exterior envelope to provide coupling or decoupling of the exterior envelope relative to the interior envelope, namely the screwing projection, which makes it possible to simplify the manufacturing process and to supply a more compact nozzle.

The sliding surface and the screwing abutment carried by the interior envelope together form a detent so as to generate a tactile and/or audible indication on the passage of the detent past the screwing projection in the safety configuration. The user then perceives a discontinuous movement of the exterior envelope and/or a sound that indicates that the cap is in the safety configuration and that they must press on the exterior envelope, for example, in the axial direction, to unscrew it.

The exterior envelope comprises a projection for unscrewing the interior envelope, and the interior envelope comprises an unscrewing surface designed to cooperate with the unscrewing projection so that:—in the safety configuration, rotation of the exterior envelope in the first direction generates relative movement of the unscrewing projection relative to the unscrewing surface so that the exterior envelope turns freely relative to the interior envelope,—in the unscrewing configuration, rotation of the exterior envelope in the first direction generates, by friction or by the unscrewing projection abutting on the unscrewing surface, driving of the interior envelope in the first direction so as to unscrew the cap.

Clearly in the situation where the interior envelope is driven by abutment, the unscrewing projection comes into contact with the unscrewing surface only in the unscrewing configuration. Driving by abutting has the advantage of improved handling of the nozzle because this requires less force to open the cap.

The screwing projection and the unscrewing projection are one and the same.

The blocking means, the exterior envelope and the interior envelope are attached components, that is to say separate from one another.

The cap comprises return means designed to separate the unscrewing projection and the unscrewing surface if a bearing force exerted on the cap has an intensity less than the predetermined threshold or if no bearing force is exerted on the cap. The return means comprise for example a flexible tongue or a conical circular skirt projecting from the interior surface of the exterior envelope. These return means also enable the exterior envelope to be moved away from the interior envelope in order to favour the evaporation of the residual liquid in the nozzle.

The cap comprises a residual liquid absorbing pad disposed in the vicinity of the liquid dispensing opening. This pad is advantageously disposed downstream of the dispensing opening and enables much of the residual liquid to be drained out of the dispensing opening.

The cap comprises a protuberance designed to be in the immediate vicinity of and facing the opening when the cap is mounted on the nozzle, that protuberance having a shape for expulsion of the residual liquid, configured to evacuate the residual liquid to the exterior when the cap is mounted on the nozzle. Thanks to the presence of the residual liquid expulsion shape produced on the removable cap, when the cap is mounted on the nozzle the expulsion shape situated in the immediate vicinity and facing the liquid distribution opening expels most of the residual liquid present downstream of the dispensing opening, in particular toward the residual liquid absorbing pad, if any, disposed in the vicinity, that is to say that the residual liquid is evacuated to the exterior of the nozzle. This drains most of the residual liquid out of the dispensing opening.

The cap has on the outside of the exterior envelope raised or visual means indicating to the user how to pass from the safety configuration to the unscrewing configuration. For example, these means may comprise a series of symbols such as arrows, digits, text indicating the order of the actions to be carried out.

The invention finally consists in a liquid dispensing device including a liquid dispensing nozzle as described above mounted on a reservoir.

BRIEF DESCRIPTION OF THE DRAWINGS

The invention will be better understood on reading the following description given by way of example only and with reference to the drawings, in which.

DETAILED DESCRIPTION OF THE INVENTION

Figure 1:
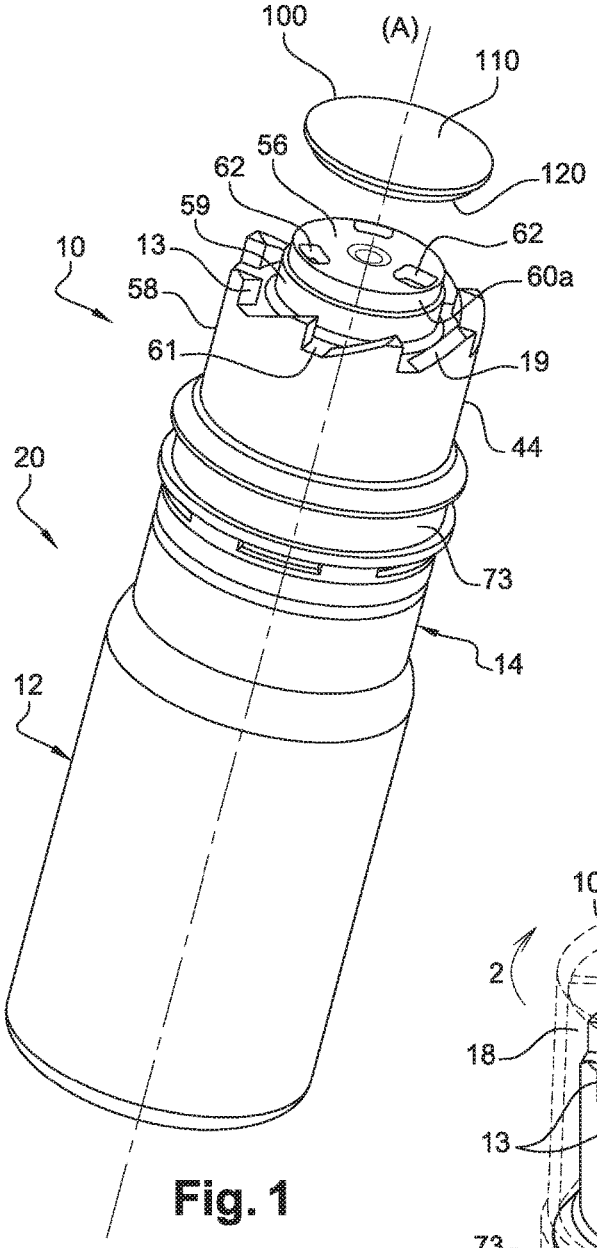
FIG. 1 is a perspective view of a dispensing device according to a first embodiment comprising a liquid dispensing nozzle with blocking means demounted, the liquid dispensing nozzle being carried by a reservoir and the exterior envelope being removed.

A device, as represented in FIG. 1 and designated by the reference 20 comprises a deformable reservoir 12 that is a storage reservoir for liquids, for example pharmaceutical liquids such as ophthalmic liquids, and a nozzle 10 for dispensing liquid in droplet form. The nozzle 10 comprises a dispensing part 14 having an opening 22 for dispensing the liquid and is designed to be mounted on the neck of the reservoir 12 by clipping, welding or screwing it on.

In accordance with the four embodiments, the nozzle 10 comprises a removable cap 16 mounted by screwing it onto the dispensing part 14 and designed to cover the opening 22 when the nozzle 10 is not being used. The cap 16 has a proximal end (P) disposed on the side of the opening of the cap 16 and an opposite distal end (D) (see FIG. 3). The cap 16 comprises an exterior envelope 42 and an interior envelope 44. These exterior and interior envelopes 42, 44 are coaxial, mounted to be mobile relative to one another in an axial direction (A) of the nozzle 10. The axial direction (A) of the nozzle 10 is defined here by the geometrical axis of the reservoir 12. The exterior and interior envelopes 42, 44 are mobile along that geometrical axis, either away from one another or toward one another. Thanks to this mobility, the exterior and interior envelopes 42, 44 are able to define in particular three distinct configurations of the nozzle 10, namely a configuration prior to first use, termed a storage configuration, a configuration for unscrewing the cap 16 and a safety configuration, which will be described in detail hereinafter.

Figure 2:
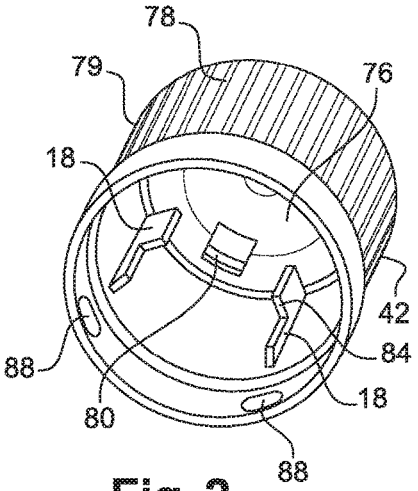
FIG. 2 is a perspective view of the interior of the exterior envelope of the nozzle from FIG. 1.
Figure 3:
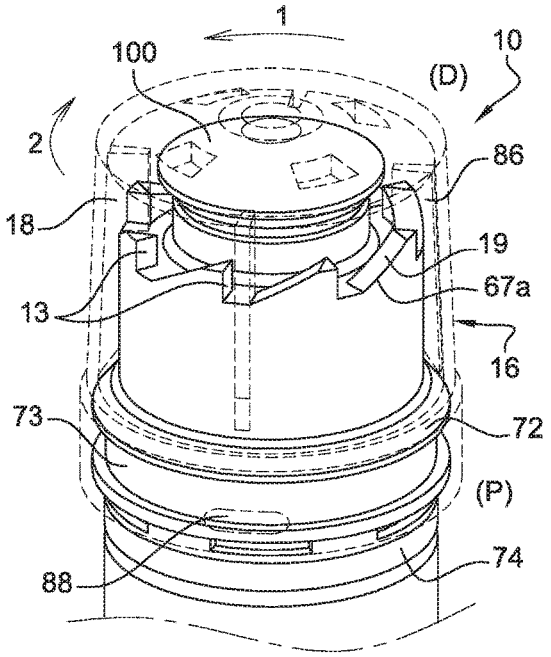
FIG. 3 is a view in perspective and partially by transparency of the nozzle from FIG. 1

FIGS. 1 to 6 illustrate a first embodiment of the nozzle 10 in which the interior envelope 44 comprises a ceiling 56, a first skirt 58 and a second skirt 59, both of substantially cylindrical shape, interconnected by a plate 61 (see FIG. 1). The ceiling 56 is delimited in this example by a cylindrical surface 60*a* connecting it to the second skirt 59 and comprises air passage orifices 62, three of them in this example. The cylindrical surface 60*a* defines a sealing surface. The interior envelope 44 further comprises a peripheral circular groove 73 arranged at the proximal end (P) of the interior envelope 44. The interior envelope 44 further comprises a plurality of guide slopes 67*a* (see FIG. 3) spaced from one another and extending from the first skirt 58 in the axial direction (A), each guide slope 67*a* having a sliding surface 19 and a screwing abutment 13. The interior envelope 44 further comprises a frangible ring 74 at the proximal end (P) of the cap 16, as can be seen in FIG. 3.

As shown in FIG. 2, the exterior envelope 42 comprises a bottom 76 and a peripheral wall 79 of substantially cylindrical shape. The bottom 76 is of circular shape and includes attachment means 80, four of them in this example, each comprising a hook-shaped end 15 connected to the bottom 76 by a circular wall (see FIG. 4). The attachment means 80 are distributed at the periphery of the bottom 76 and delimit between them a housing. The bottom 76 also comprises air passage through-orifices 82, each being formed in the vicinity of one of the attachment means 80.

The exterior envelope 42 further comprises a plurality of gadroons 88 projecting from the interior surface of the peripheral wall 79 (see FIG. 2). The exterior envelope 42 also comprises a screwing projection 18 arranged on the internal surface of the exterior envelope 42 at the level of the distal end (D). Here the screwing projection 18 takes the form of a lug 84 projecting both from the bottom 76 and from the peripheral wall 79. To be more precise the lug 84 comprises a lower surface oriented toward the proximal end (P) of the cap 16 and a lateral surface 86 forming a lateral screwing abutment 86.

In this embodiment the nozzle 10 comprises blocking means 100 comprising a substantially flat disk 110 and a cylindrical wall 120 extending toward the proximal end (P) from the flat disk 110 and defining a sealing surface on the interior face of the cylindrical wall 120. The disk 110 is mounted in the housing defined by the attachment means 80 of the exterior envelope 42 so that the blocking means 100 are retained by the hook-shaped end 15 of the attachment means 80.

The assembly and the operation of the nozzle 10 according to this first embodiment are described next.

The exterior envelope 42 is first mounted, with the disk 100, on the interior envelope 44 by positioning the screwing projections 18 between two guide slopes 67*a*, as can be seen in FIG. 3, so that the disk 100 is mounted on the second skirt 59 of the interior envelope 44 by a tight fit of the cylindrical wall 120 on the cylindrical surface 60*a*. In this assembly example the cap 16 is therefore ready to be mounted by screwing it onto the dispensing part 14. Once the reservoir 12 has been filled with the liquid to be dispensed, the nozzle 10, comprising the cap 16 and the dispensing part 14, is mounted on the neck of the reservoir 12, for example by screwing it on, clipping it on or by any other known technique. The nozzle 10 is in the storage configuration and is ready to be used.

Figure 4:
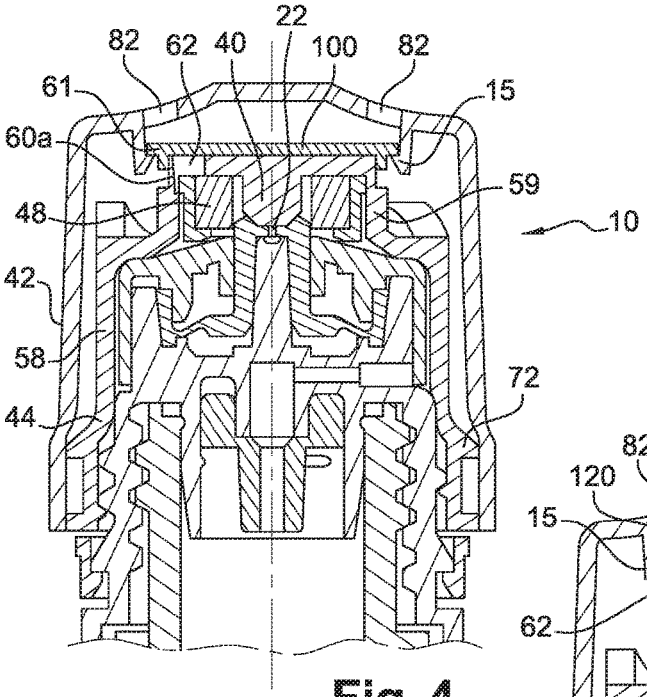
FIG. 4 is a sectional view of the nozzle from FIG. 1 in the storage configuration.

The storage configuration of the nozzle 10 is shown in FIG. 4. The blocking means 100 covering the air passage orifices 62 of the interior envelope 44 are here in the blocking position. The two sealing surfaces defined by the cylindrical wall 120 and the cylindrical surface 60*a* are in fluid-tight contact with one another in this blocking position with the result that there is no communication between the air passage orifices 62 of the interior envelope 44 and the air passage orifices 82 of the exterior envelope 42.

Figure 5:
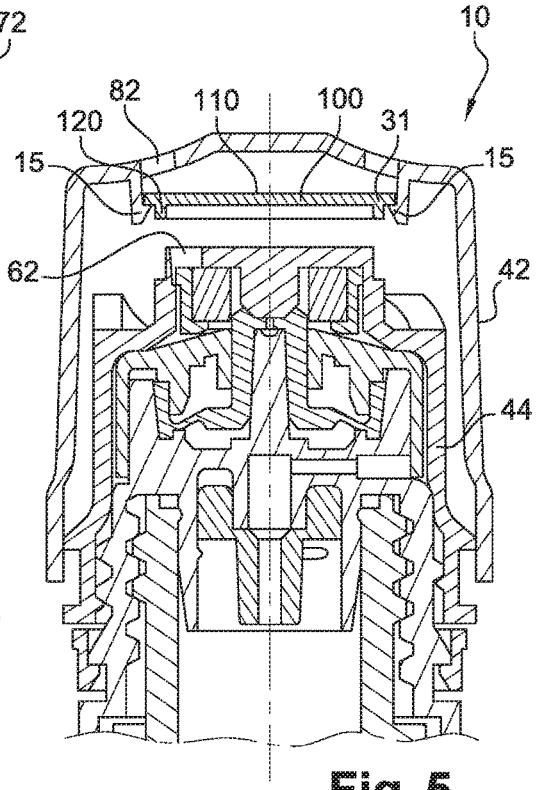
FIG. 5 is a sectional view of the nozzle from FIG. 1 in the safety configuration.

On first use, the user unscrews the cap 16. They grip the exterior envelope 42 in one hand and the reservoir 12 in the other hand. They turn the exterior envelope 42 relative to the interior envelope 44 in a first direction 1, which corresponds to the anticlockwise direction, as can be seen in F 3. The screwing projections 18 are then guided by the guide slopes 67*a* and are moved on the sliding surfaces 19. The rotation movement applied by the user to the nozzle 10 generates movement of axial translation of the exterior envelope 42 relative to the interior envelope 44. Thanks to this movement out of the storage configuration, the blocking means 100 are driven by the attachment means 80 of the exterior envelope 42 and are moved in the axial direction (A) relative to the interior envelope 44 and away from the latter, as shown in FIG. 5. The sealing surfaces are therefore separated from one another and a gap is created between them so as to allow air to pass between them, which means that the blocking means 100 pass from the blocking position to the opening position. The residual liquid evaporation path passing through the air passage orifices 62, 82 is blocked in the storage configuration and open in the safety and unscrewing configuration.

Once the cap 16 is no longer in the storage configuration, the user, preferably an adult, is able to open the cap 16 by applying to it a bearing force of intensity greater than a predetermined threshold, in the present instance an axial bearing force. The cap 16 is then moved to the unscrewing configuration. In that configuration, by rotation of the exterior envelope 42 in the first direction 1 in combination with the bearing force each screwing projection 18 comes to abut against a corresponding sliding surface 19. The bearing force on the exterior envelope 42 is then transmitted to the sliding surface 19 and so friction is generated between the screwing projection 18 and the sliding surface 19. This friction enables the screwing projection 18 and the sliding surface 19 to be fastened together so that the exterior envelope 42 can drive the interior envelope 44 in rotation in this first direction 1 without the screwing projection 18 sliding on the sliding surface 19 or with sliding generating sufficient friction to drive the interior envelope 44 in rotation. In this example, the sliding surface 19 is also an unscrewing surface. The cap 16 is therefore unscrewed from the dispensing part 14. Gripping ribs 78 are disposed on the external periphery of the exterior envelope 42 in order to facilitate the transmission of the bearing and rotation forces.

Clearly if the user continues the movement of rotation of the cap 16 relative to the reservoir 12 in order to unscrew the cap 16 completely from the dispensing part 14, they will break the frangible parts of the ring 74. This ring 74 therefore provides a simple way of showing that the nozzle 10 has not been opened previously. The groove 73 of the interior envelope 44 is configured to receive the gadroons 88 so as to enable free rotation of the gadroons 88 in the groove 73 without the exterior envelope 42 being detached completely from the interior envelope 44.

Thereafter, if the user, for example a child, merely turns the exterior envelope 42 in the first direction 1, without pressing sufficiently strongly in the axial direction on the bottom 76, the cap 16 is again in the safety configuration. Because the force transmitted to the sliding surface 19 does not enable sufficient friction to be generated, the screwing projection 18 is moved on the guide slope 67*a* to its summit. The screwing projection 18 thereafter returns to the bottom of the guide slope 67*a* and the exterior envelope 42 returns to its bottom position relative to the interior envelope 44. In this way, rotation of the exterior envelope 42 in the first direction 1 generates sliding of the screwing projections 18 on each sliding surface 19 in succession, so as to freewheel relative to the interior envelope 44. In this safety configuration, the screwing projections 18 are moved from one guide slope 67*a* to another intermittently. The guide slopes 67*a*, which are spaced from one another, therefore form a discontinuous cam path and the passage of the screwing projection 18 over the discontinuity in the cam path generates a tactile or even sound indication.

Between two uses, the user screws the cap 16 back onto the dispensing part 14. It suffices merely to turn the exterior envelope 42 in a second direction 2, corresponding to the clockwise direction, without exerting any specific bearing force. Each lateral screwing abutment 86 carried by the screwing projection 18 then comes to abut against the screwing abutment 13 carried by the interior envelope 44. The exterior and interior envelopes 42, 44 are therefore connected in movement in rotation in the second direction 2 and the cap 16 can be screwed back on.

Figure 6:
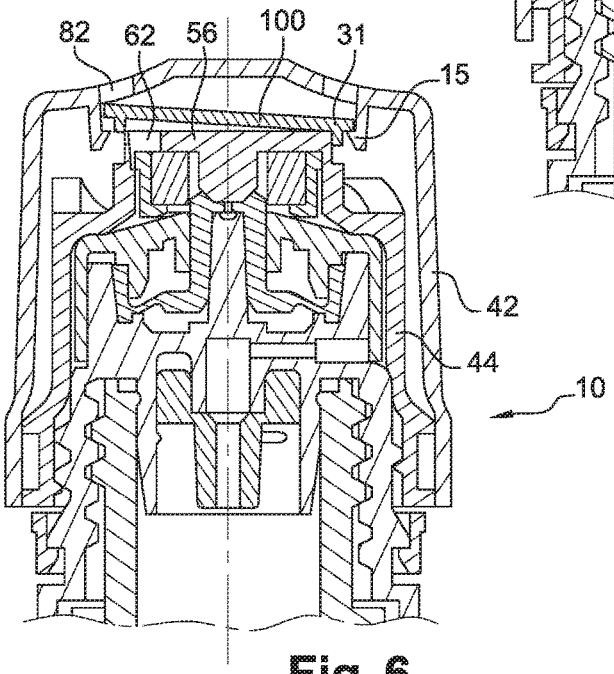
FIG. 6 is a sectional view of the nozzle from FIG. 1 in the unscrewing configuration.

When the exterior envelope 42 returns to the bottom position relative to the interior envelope 44, the blocking means 100 come into contact with the second skirt 59. Given that the ceiling 56 has a diameter greater than that of the cylindrical wall 120 of the blocking means, the ceiling 56 pushes the cylindrical wall 120 back in its housing without the blocking means 100 being able to return to its blocking position as shown in FIG. 6. It is therefore clear that it is possible to go from the storage configuration of the nozzle 10 to the safety or unscrewing configuration but the converse is not possible. It is therefore guaranteed that once the nozzle 10 has been opened at least once, the residual liquid evaporation path is always open.

Figure 7:
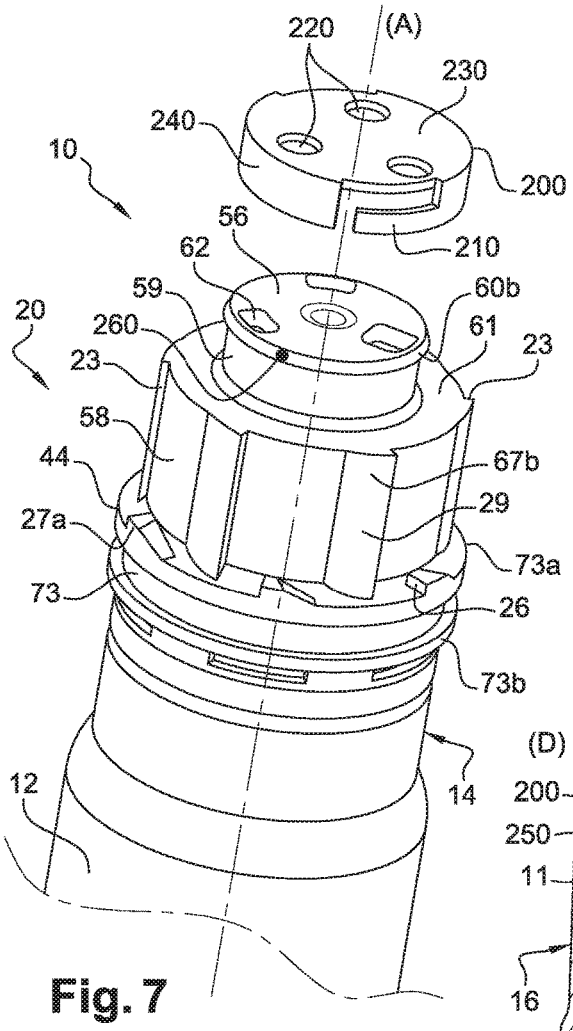
FIG. 7 is a view similar to FIG. 1 of a dispensing device according to a second embodiment.
Figure 8:
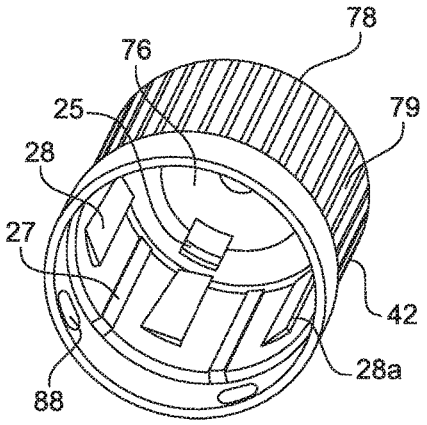
FIG. 8 is a perspective view of the interior of the exterior envelope of the nozzle from FIG. 7.
Figure 9:
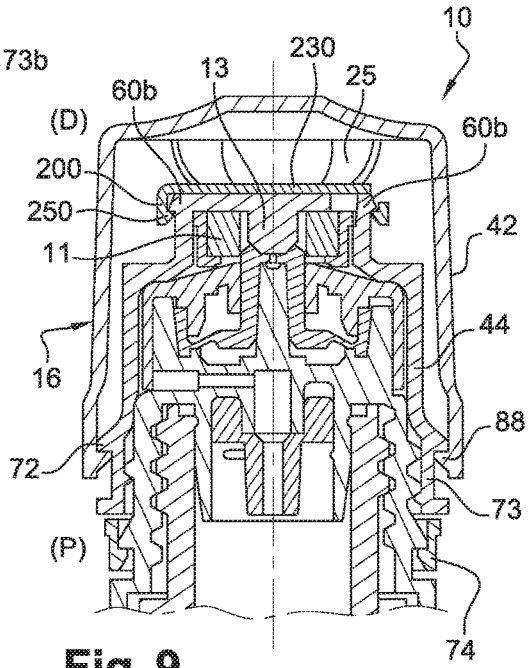
FIG. 9 is a sectional view of the nozzle from FIG. 7 in the storage configuration.

FIGS. 7 to 11 illustrate a second embodiment of the nozzle 10 in which the interior envelope 44 comprises a ceiling 56, a first skirt 58 and a second skirt 59 both of substantially cylindrical shape interconnected by a plate 61. The ceiling 56 comprises air passage orifices 62, three of them in this example. The second skirt 59 comprises at its end a flange 60*b* having a substantially frustoconical peripheral surface in which are arranged two stopping points 260 on respective opposite sides of the axis of the nozzle 10. In this example the ceiling 56 defines a sealing surface. The interior envelope 44 further comprises a plurality of guide slopes 67*b* spaced from one another and extending from the first skirt 58 in a transverse direction relative to the axial direction (A), each guide slope 67*b* including a sliding surface 29 and a screwing abutment 23. The interior envelope 44 further comprises a frangible ring 74 at the proximal end (P) of the cap 16, as can be seen in FIG. 9.

As in the first embodiment, the interior envelope 44 comprises a peripheral circular groove 73 arranged at the proximal end (P) of the interior envelope 44. The groove 73 is delimited by an upper rim 73*a* and a lower rim 73*b* as shown in FIG. 7. The interior envelope 44 comprises a plurality of detents 27*a* extending from the upper rim 73*a* of the groove 73 in the axial direction (A) and each having an unscrewing surface 26. The detents 27*a* and the guide slopes 67*b* are interleaved.

As can be seen in FIG. 8, the exterior envelope 42 comprises a bottom 76 and a peripheral wall 79 of substantially cylindrical shape. The bottom 76 is of circular shape and includes return means 25, in this example taking the form of flexible tongues 25 extending from the bottom 76 toward the proximal end (P) and slightly toward the centre of the exterior envelope 42. There are four flexible tongues 25 in this example. The bottom 76 also comprises air passage orifices 82, each of them being in the vicinity of a flexible tongue 25. The exterior envelope 42 further comprises a plurality of gadroons 88 projecting from the interior surface of the peripheral wall 79.

The exterior envelope 42 comprises a plurality of screwing projections 28 arranged on the internal surface of the peripheral wall 79. Here a screwing projection 28 takes the form of a flexible blade 28 connected to the peripheral wall 79 by a longitudinal side of the flexible blade 28. The flexible blade 28 is therefore able to flex about that longitudinal side. Its opposite side includes a lateral screwing abutment 28*a*. The exterior envelope 42 further comprises on the internal surface of the peripheral wall 79 a plurality of unscrewing projections 27 having a thickness that increases from the distal end (D) toward the proximal end (P) of the exterior envelope 42. Each unscrewing projection 27 includes a lateral unscrewing abutment 27*b* (see FIG. 11).

In this embodiment, the nozzle 10 comprises blocking means 200 comprising a substantially flat disk 230 having a sealing surface and comprising a substantially cylindrical peripheral skirt taking the form of two semi-annular walls 240 spaced from one another by an empty zone and extending axially from the periphery of the sealing surface. The blocking means 200 comprise two flexible lugs 210 each of semi-annular shape extending from a semi-annular wall 240 toward the empty zone. In other words, each flexible lug 210 delimits with each semi-annular wall 240 an L-shaped notch defining a bayonet coupling shape (see FIG. 7). Each semi-annular wall 240 and each flexible lug 210 further include on the proximal side (P) an internal rim 250 (see FIG. 9). The disk 230 further includes air passage orifices 220, three of them in this example, of circular shape.

The blocking means 200 are mounted on the second skirt 59 of the interior envelope 44 by clipping cooperation between the flange 60*b* and the internal rim 250 of the blocking means 200. Thanks to the elasticity of the flexible lugs 210, the blocking means 200 are mounted so as to be fixed relative to the second skirt 59 in the axial direction (A), the flange 60*b* abutting on the internal rim 250 of the blocking means 200. Moreover, the blocking means 200 are mounted to be mobile in rotation relative to the second skirt 59.

The assembly and the operation of the nozzle 10 according to this second embodiment are described next.

Figure 11:
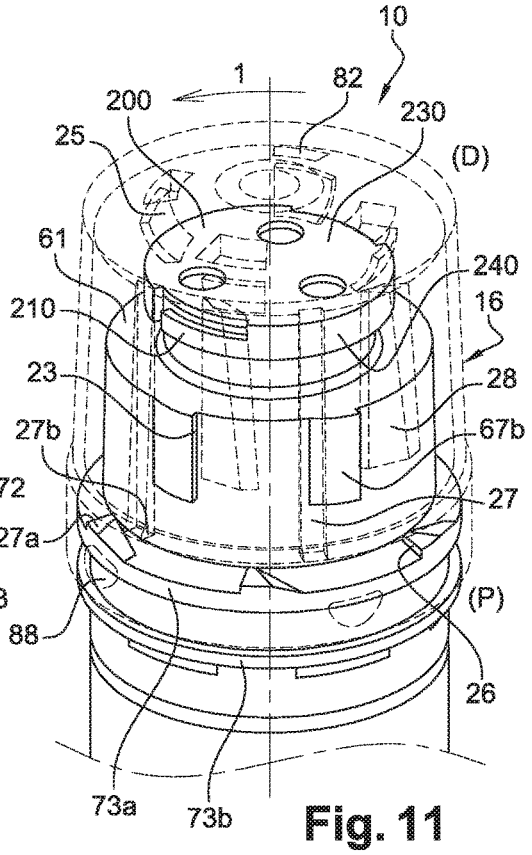
FIG. 11 is a view in perspective and partially by transparency of the nozzle form FIG. 7 in the storage configuration.
Figure 12:
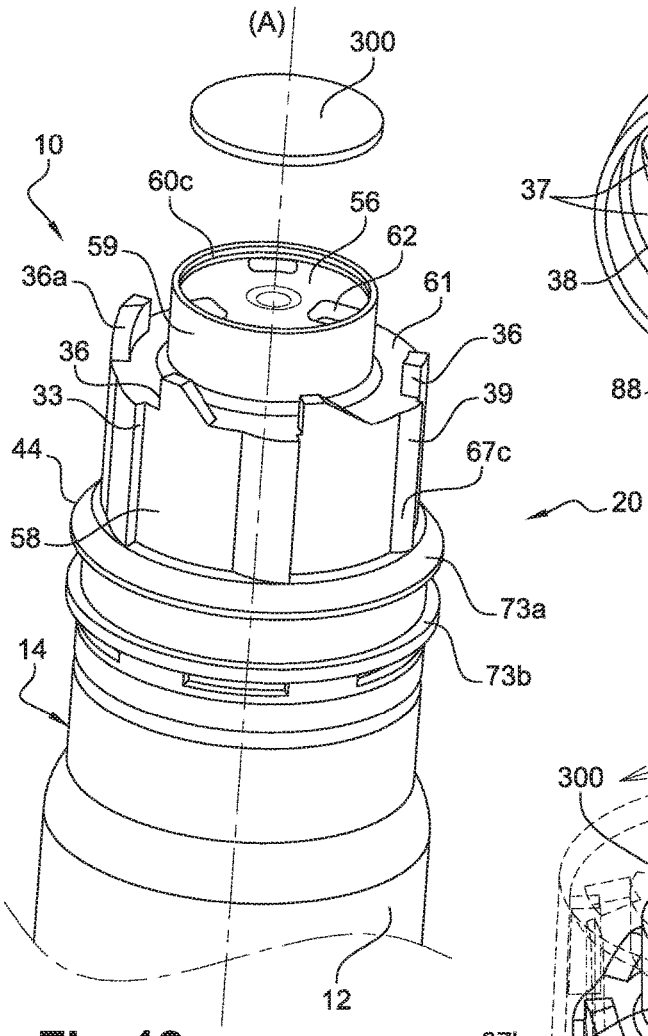
FIG. 12 is a view similar to FIG. 1 of a dispensing device according to a third embodiment.

The exterior envelope 42 is first mounted on the interior envelope 44 by positioning a screwing projection 28 and an unscrewing projection 27 between two guide slopes 67*b*, as can be seen in FIG. 11. The flexible tongues 25 then bear against the flat disk 230 of the blocking means 200 and the gadroons 88 bear against the upper rim 73*a* so that the exterior and interior envelopes 42, 44 are fastened together in the axial direction (A) in the storage configuration, as can be seen in FIG. 11. In this position the flexible lugs 210 bear on their respective stopping point 260 and the unscrewing projections 27 are located over the detents 27*a* and are not in contact with the latter. The cap 16 is therefore ready to be mounted by screwing it onto the dispensing part 14. Once the reservoir 12 has been filled with the liquid to be dispensed the nozzle 10, comprising the cap 16, is mounted on the neck of the reservoir 12, for example by screwing it on, clipping it on or by any other known technique. The nozzle 10 is ready to be used.

The storage configuration of the nozzle 10 is represented in FIG. 11. The air passage orifices 220 carried by the blocking means 200 are offset relative to the air passage orifices 62 of the interior envelope 44. The air passage orifices 62 of the interior envelope 44 are therefore blocked by the blocking means 220. The two sealing surfaces defined by the ceiling 56 and the disk 230 are in fluid-tight contact with each another with the result that there is no communication between the air passage orifices 62 of the interior envelope 44 and the air passage orifices 82 of the exterior envelope 42. The blocking means 200 are therefore in the blocking position in this storage configuration.

Figure 10:
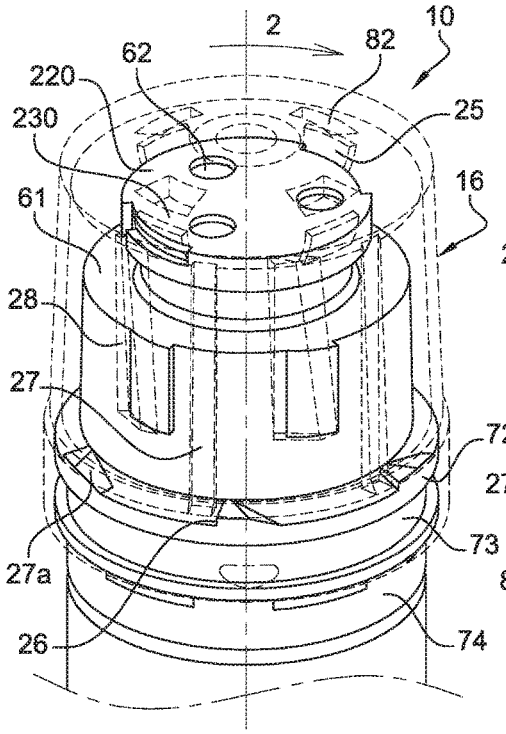
FIG. 10 is a view in perspective and partially by transparency of the nozzle from FIG. 7 in the unscrewing configuration.

On first use, the user unscrews the cap 16. They grip the exterior envelope 42 in one hand and the reservoir 12 in the other hand. They turn the exterior envelope 42 relative to the interior envelope 44 in a first direction 1 that corresponds to the anticlockwise direction, as can be seen in FIG. 11. The flexible tongues 25 then drive the blocking means 200 in rotation thanks to the friction generated between the flexible tongues 25 and the disk 230. Rotation of the blocking means 200 is limited by the two stopping points 260, which come to abut against the semi-annular walls 240. The air passage orifices 220 are configured so that each is positioned facing an orifice 62 of the interior envelope 44 when the blocking means 200 reach the end of their rotation, as can be seen in FIG. 10. The blocking means 200 therefore pass from the blocking position to the opening position by rotation of the blocking means 200 relative to the interior envelope 44 in the first direction 1. The residual liquid evaporation path is blocked in the storage configuration and open in the safety and unscrewing configuration. The blocking means 200 are immobilized in their opening position by the ends of the flexible lugs 210 that come to abut against the stopping points 260 during any rotation in the second direction 2 opposite the first direction 1.

The user, preferably an adult, can then open the cap 16 by applying to it an axial bearing force with an intensity greater than a predetermined threshold, against the return force of the flexible tongues 25. The exterior envelope 42 is then moved in the axial direction (A) toward the interior envelope 44 and the screwing projections 28 are positioned at the same level as the detents 27*a*. At the same time this causes the exterior envelope 42 to turn relative to the interior envelope 44 in a first direction 1 that corresponds to the anticlockwise direction. The cap 16 is then in the unscrewing configuration.

In this unscrewing configuration, each unscrewing projection 27 comes to abut against an unscrewing surface 26 carried by the detent 27*a*, which makes it possible to fasten together the exterior and interior envelopes 42, 44. The exterior envelope 42 therefore drives the interior envelope 44 in rotation in this first direction 1. The cap 16 is therefore unscrewed from the dispensing part 14. Gripping ribs 78 are disposed at the external periphery of the exterior envelope 42 in order to facilitate the transmission of the bearing and rotation forces.

It is clear that if the user continues the movement of rotation of the cap 16 relative to the reservoir 12 in order to unscrew the cap 16 completely from the dispensing nozzle 14 they will break the frangible parts of the ring 74. This ring 74 therefore provides a simple way to verify that the nozzle 10 has not been opened previously. The groove 73 of the interior envelope 44 is configured to receive the gadroons 88 so as to enable free rotation of the gadroons in the groove 73 without the exterior envelope 42 being detached completely from the interior envelope 44, thanks to the presence of the upper rims 73*a*.

As an alternative to the frangible ring 74, the cap 16 may comprise zones with different colours on the blocking means 200, each zone being positioned to face an air passage orifice 82 carried by the exterior envelope 42 in the storage configuration or after the first opening of the nozzle 10. The colour shown therefore tells the user whether the nozzle has already been opened or not.

Thereafter, if a child, for example, merely turns the exterior envelope 42 in the first direction 1 without pressing axially sufficiently strongly on the bottom 76, the cap 16 returns to the safety configuration. In fact, the flexible tongues 25 make it possible to move the exterior envelope 42 away from the interior envelope 44 so that the unscrewing projections 27 cannot come into contact with the detents 27*a*. The flexible blades 28 slide on the sliding surfaces 29 carried by the guide slopes 67*b* and are compressed on advancing on the guide slopes 67*b*. When the flexible blades 28 are no longer in contact with the guide slopes 67*b* they expand and return to their initial position. In this way, rotation of the exterior envelope 42 in the first direction 1 generates sliding of the flexible blade 28 on each sliding surface 29 in succession so as to freewheel relative to the interior envelope 44. In this safety configuration, the flexible blades 28 are moved from one guide slope 67*b* to another intermittently. Each sliding surface 29 and the adjacent screwing abutment 23 therefore form a detent. The passage of each flexible blade 28 over each detent generates a tactile or even audible indication.

Between two uses, the user screws the cap 16 back onto the dispensing part 14. It suffices merely to turn the exterior envelope 42 in a second direction 2 corresponding to the clockwise direction without exerting a specific bearing force. Each lateral screwing abutment 28*a* carried by the screwing projection 28 then comes to abut against the screwing abutment 23 carried by the guide slope 67*b*. The exterior and interior envelopes 42, 44 are therefore connected in movement in rotation in the second direction 2 and the cap 16 can be screwed back on.

It is therefore clear that is possible to pass from the storage configuration of the nozzle 10 to the safety or unscrewing configuration but that the converse is not possible. It is therefore guaranteed that once the nozzle 10 has been opened at least once the residual liquid evaporation path is always open.

Figure 13:
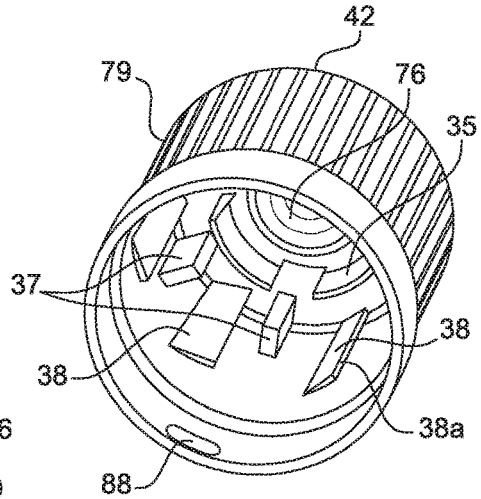
FIG. 13 is a perspective view of the interior of the exterior envelope of the nozzle from FIG. 12.
Figure 14:
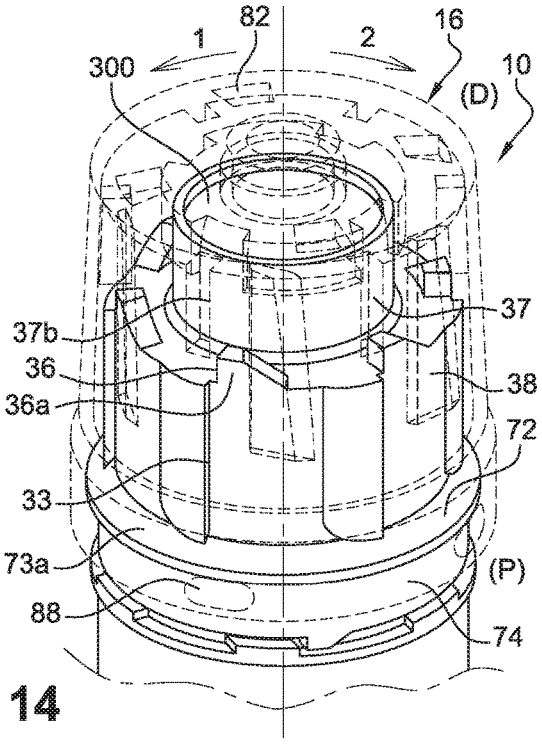
FIG. 14 is a view in perspective and partially by transparency of the nozzle from FIG. 12 in the safety configuration.

FIGS. 12 to 17 illustrate a third embodiment of the nozzle 10 in which the interior envelope 44 comprises a ceiling 56, a first skirt 58 and a second skirt 59 both of cylindrical shape interconnected by a plate 61. As can seen in FIG. 12, the ceiling 56 comprises air passage orifices 62, three of them in this example. The second skirt 59 comprises return means in the form of a deformable wall 60*c* (see FIG. 15) extending from the periphery of the ceiling 56 and comprises an interior rim at its distal end (D). In this example the rim defines a sealing surface. The interior envelope 44 further comprises a plurality of guide slopes 67*c* spaced from one another and extending from the first skirt 58 in a transverse direction relative to the axial direction (A), each guide slope 67*c* including a sliding surface 39 and a screwing abutment 33 (see FIG. 12). The interior envelope 44 further comprises a frangible ring 74 at the proximal end (P) of the cap 16, as can be seen in FIG. 14.

The interior envelope 44 comprises an upper rim 73*a* arranged between the first skirt 58 and the proximal end (P). The interior envelope 44 comprises a plurality of detents 36*a* extending from the plate 61 in the axial direction (A) and each having a sliding surface 36 (see FIG. 12). The detents 36*a* and the guide slopes 67*c* are interleaved.

As can be seen in FIG. 13, the exterior envelope 42 comprises a bottom 76 and a peripheral wall 79 of substantially cylindrical shape. The bottom 76 is of circular shape and comprises blades 35 extending from the bottom 76 toward the proximal end (P) of the exterior envelope 42. The blades 35 substantially form a conical circular skirt projecting from the interior surface of the exterior envelope 42 so that the internal surfaces of the blades 35 have a substantially discontinuous cone shape. There are four blades 35 in this example. The bottom 76 further comprises at its centre projecting a rigid ring. The bottom 76 also comprises air passage orifices 82 each in the vicinity of a blade 35. The exterior envelope 42 further comprises a plurality of gadroons 88 projecting from the interior surface of the peripheral wall 79.

The exterior envelope 42 comprises a plurality of screwing projections 38 arranged on the internal surface of the peripheral wall 79. Here a screwing projection 38 takes the form of a flexible blade 38 connected to the peripheral wall 79 by one longitudinal side of the flexible blade 38. The flexible blade 38 is therefore able to flex about that longitudinal side. Its opposite side includes a lateral screwing abutment 38*a* (see FIG. 13). The exterior envelope 42 further comprises on the internal surface of the peripheral wall 79 a plurality of unscrewing projections 37 arranged at the proximal end (P) of the exterior envelope 42. Each unscrewing projection 37 includes a lateral unscrewing abutment 37*b*.

In this embodiment, the nozzle 10 comprises locking means 300 in the form of a substantially flat disk in the shape of a pastille, the peripheral surface of which defines a sealing surface. The pastille 300 includes protruding lines on a face oriented toward the proximal end (P). The blocking means 300 are mounted on the rim of the deformable wall 60*c* by a tight fit in the storage configuration.

The assembly and the operation of the nozzle 10 in accordance with this third embodiment are described next.

Figure 21:
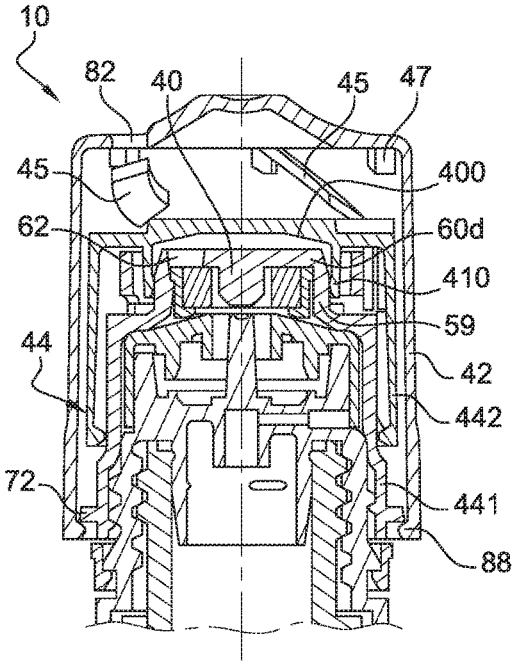
FIG. 21 is a sectional view of the nozzle from FIG. 18 in the storage configuration.

The exterior envelope 42 is first mounted on the interior envelope 44 by positioning each unscrewing projection 37 between two detents 36*a*. In this position, the unscrewing projections 37 are located above the detents 36*a* and are not in contact with the latter. The deformable wall 60*c* is positioned between the blades 35 and the gadroons bear on the upper rim 73*a* with the result that the exterior and interior envelopes 42, 44 are fastened together in the axial direction in the storage configuration, as can be seen in FIG. 21. The cap 16 is therefore ready to be mounted by screwing it onto the rest of the dispensing part 14. Once the reservoir 12 has been filled with the liquid to be dispensed, the nozzle 10, comprising the cap 16, is mounted on the neck of the reservoir 12, for example by screwing it on, clipping it on or by any other known technique. The nozzle 10 is in the storage configuration, ready to be used.

Figure 15:
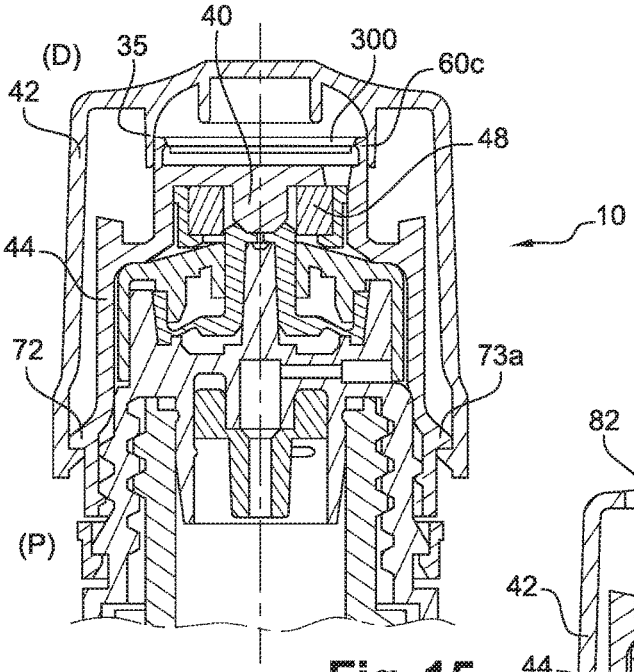
FIG. 15 is a sectional view of the nozzle from FIG. 12 in the storage configuration.

The storage configuration of the nozzle 10 is represented in FIG. 15. The two sealing surfaces defined by the deformable wall 60*c* and by the peripheral surface of the blocking means 300 are in fluid-tight contact with one another with the result that there is no communication between the air passage orifices 62 of the interior envelope 44 and the air passage orifices 82 of the exterior envelope 42. The orifices 62 of the interior envelope 44 are blocked by the blocking means 300. The blocking means 300 are therefore in the blocking position in this storage configuration.

On first use, the user unscrews the cap 16. They grip the exterior envelope 42 in one hand and the reservoir 12 in the other hand. They press on the exterior envelope 42 in the axial direction and simultaneously cause it to turn relative to the interior envelope 44 in a first direction 1 that corresponds to the anticlockwise direction, as can be seen in FIG. 14. The exterior envelope 42 is then moved in the axial direction (A) toward the interior envelope 44 and the projecting ring comes into contact with the blocking means 300 and drives them with the same movement. The blocking means 300 are therefore pushed into the deformable wall 60*c* and can no longer emerge thanks to the rim of the deformable wall 60*c*. Thanks to the protruding lines that are arranged on the blocking means 300, a gap is always present between the blocking means 300 and the ceiling 56 to guarantee the circulation of air between the orifices 62 and the exterior of the nozzle 10. The blocking means 300 therefore pass from the blocking position to the opening position by movement in translation of the blocking means 300 relative to the interior envelope 44 in the axial direction (A).

After the first opening of the nozzle 10, the sealing surfaces are no longer in fluid-tight contact with one another. The exterior and interior envelopes 42, 44 include air passage orifices 62, 82 enabling a residual liquid evaporation path to be created between the opening 22 and the exterior of the nozzle 10. The residual liquid evaporation path is blocked in the storage configuration and open in the safety and unscrewing configuration.

The user, preferably an adult, can open the cap 16 by applying to it a force having an intensity greater than a predetermined threshold. The cap 16 is then in the unscrewing configuration.

In that unscrewing configuration, after the movement of the exterior envelope 42 in the axial direction (A) toward the interior envelope 44, the unscrewing projections 37 are positioned at the same level as the notches 36*a*. On rotation of the exterior envelope 42, each unscrewing projection 37 comes to abut against an unscrewing surface 36 carried by the detent 36*a*, which enables the exterior and interior envelopes 42, 44 to be fastened together. The exterior envelope 42 therefore drives the interior envelope 44 in rotation in this first direction 1. The cap 16 is therefore unscrewed from the rest of the nozzle 10. Gripping ribs 78 are disposed on the external periphery of the exterior envelope 42 in order to facilitate the transmission of bearing and rotation forces.

It is clear that if the user continues the rotation movement of the cap 16 relative to the reservoir 12 in order to unscrew the cap 16 completely from the dispensing part 14, they will break the frangible parts of the ring 74. This ring 74 therefore provides a simple way to verify that the nozzle 10 has not been open previously. The upper rim 73*a* of the interior envelope 44 is configured to prevent the exterior envelope 42 from being detached completely from the interior envelope 44.

Figure 16:
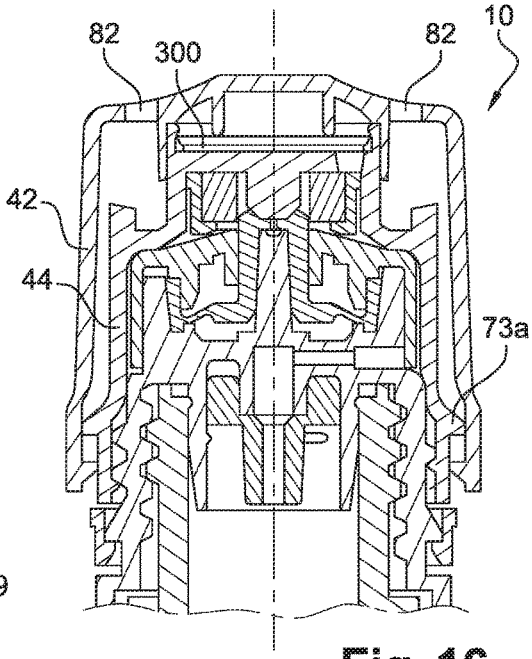
FIG. 16 is a sectional view of the nozzle from FIG. 12 in the safety configuration.
Figure 17:
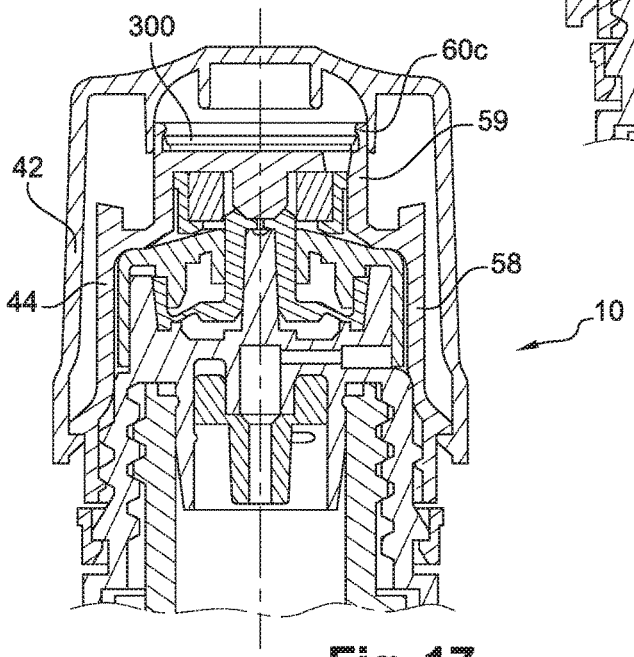
FIG. 17 is a sectional view of the nozzle from FIG. 12 in the unscrewing configuration.

Thereafter if the user, for example a child, merely turns the exterior envelope 42 in the first direction 1, without pressing sufficiently strongly in the axial direction on the bottom 76, the cap 16 returns to the safety configuration. Because of the return force generated by the deformation of the deformable wall 60*c*, the latter pushes on the internal surfaces of the blades 35, which enables the exterior envelope 42 to be held away from the interior envelope 44 so that the unscrewing projections 37 cannot come into contact with the detents 36*a*, as can be seen in FIG. 16. The flexible blades 38 slide on the sliding surfaces 39 carried by the guide slopes 67*c* and are compressed on advancing on the slopes. When the flexible blades 38 are no longer in contact with the guide slopes 67*c*, they expand and return to their initial position. In this way, rotation of the exterior envelope 42 in the first direction 1 generates sliding of the flexible blade 38 on each successive sliding surface 39, so as to freewheel relative to the interior envelope 44. In this safety configuration, the flexible blades 38 are moved from one guide slope 67*c* to another intermittently. The guide slopes 67*c* spaced from one another therefore form a discontinuous cam path and the passing of the flexible blade 38 over the discontinuity in the cam path generates a tactile or even audible indication.

Between two uses, the user screws the cap 16 back onto the dispensing part 14. It suffices merely to turn the exterior envelope 42 in a second direction 2 corresponding to the clockwise direction without exerting a specific bearing force. Each lateral screwing abutment 38*a* carried by the screwing projection 38 then comes to abut against the screwing abutment 33 carried by the guide slope 67*c*. The exterior and interior envelopes 42, 44 are therefore connected in movement in rotation in the second direction 2 and the cap 16 can be screwed back on.

Once the blocking means 300 are located in the deformable wall 60*c*, they can no longer return to the blocking position. It is therefore clear that it is possible to pass from the storage configuration of the nozzle 10 to the safety or unscrewing configuration but that the converse is not possible. It is therefore guaranteed that once the nozzle 10 has been opened at least once the residual liquid evaporation path is always open.

Figure 18:
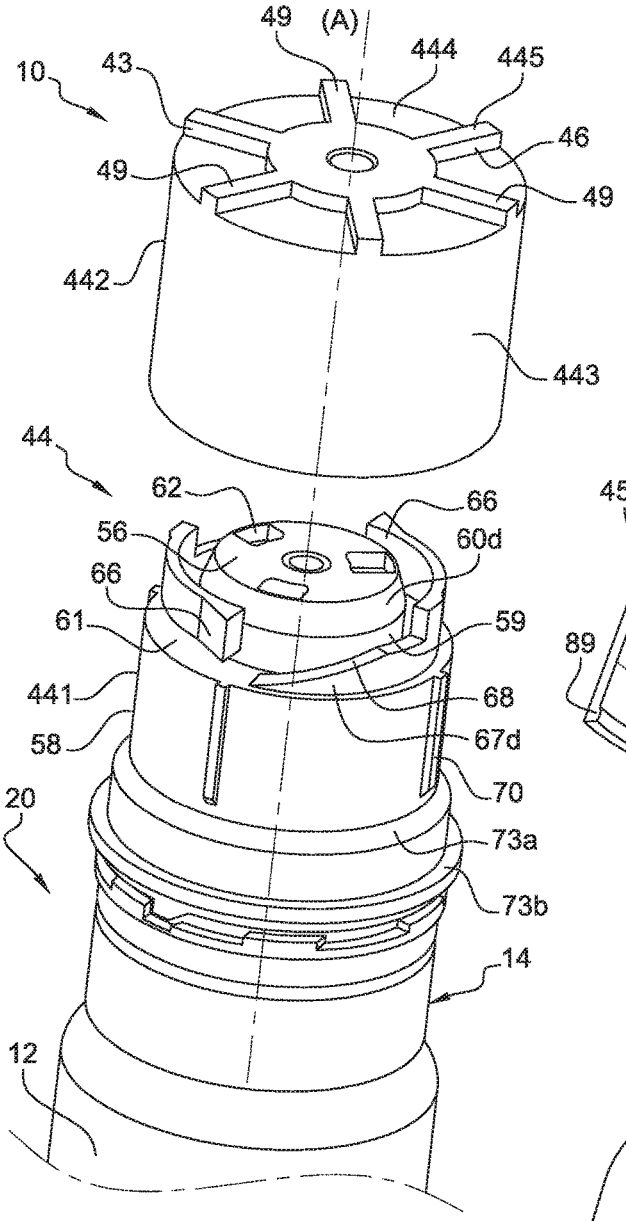
FIG. 18 is a view similar to FIG. 1 of a dispensing device according to a fourth embodiment.
Figure 22:
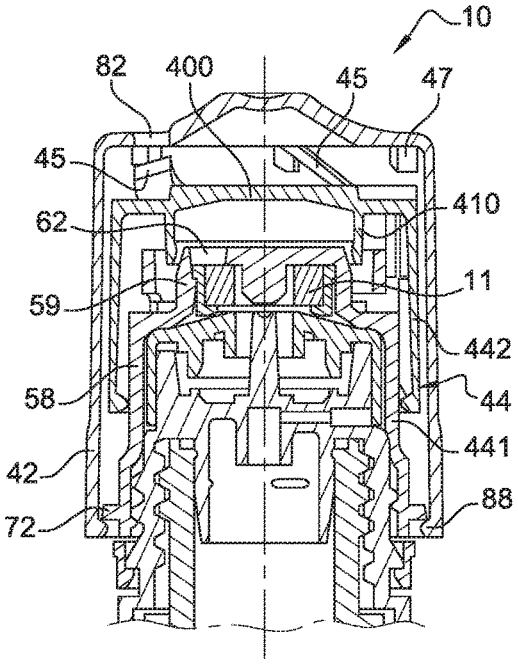
FIG. 22 is a sectional view of the nozzle from FIG. 18 in the safety configuration.
Figure 23:
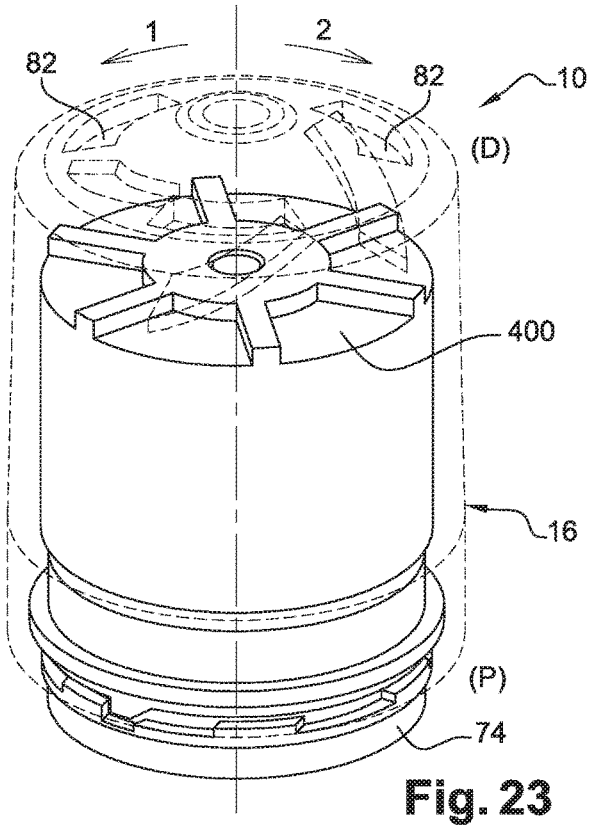
FIG. 23 is a view in perspective and partly by transparency of the nozzle form FIG. 18 in the safety configuration.

FIGS. 18 to 23 illustrate a fourth embodiment of the nozzle 10 in which the interior envelope 44 comprises a first part 441 as shown in FIG. 18. This first part 441 of the interior envelope 44 comprises a ceiling 56, a first skirt 58 and a second skirt 59 both of substantially cylindrical shape interconnected by a plate 61. The ceiling 56 is delimited in this embodiment by a cylindrical surface 60*d* connecting it to the second skirt 59 and comprises air passage orifices 62, three of them in this example. The second skirt 59 defines a sealing surface. The first part 441 of the interior envelope 44 further comprises two guide slopes 67*d* spaced from one another and extending from the first skirt 58 in the axial direction (A), each guide slope 67*d* including a guide surface 68. The first part 441 of the interior envelope 44 also comprises two elastic lugs 66 and two fixing abutments 70 (see FIG. 18). The first part 441 of the interior envelope 44 further comprises an upper rim 73*a* arranged between the first skirt 58 and the proximal end (P) and a frangible ring 74 at the proximal end (P) of the cap 16, as can be seen in FIG. 23.

Figure 20:
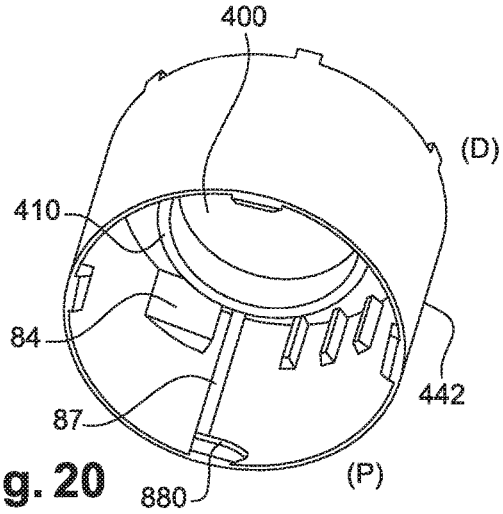
FIG. 20 is a perspective view of the interior of the interior envelope of the nozzle from FIG. 18.

The interior envelope 44 comprises a second part 442 as can be seen in FIGS. 18 and 20. This second part 442 comprises a bottom 444 and a cylindrical body 443 having an internal surface on which are arranged two fixing detents 84 and complementary fixing abutments 87. The bottom 444 comprises a plurality of branches 445 each extending radially from the centre to the periphery of the bottom 444. The branches 445 form a star with six branches in the example shown. Each branch 445 includes a sliding surface 49 and an unscrewing surface 46. The second part 442 of the interior envelope 44 further comprises gadroons 880 at the proximal end (P).

Figure 19:
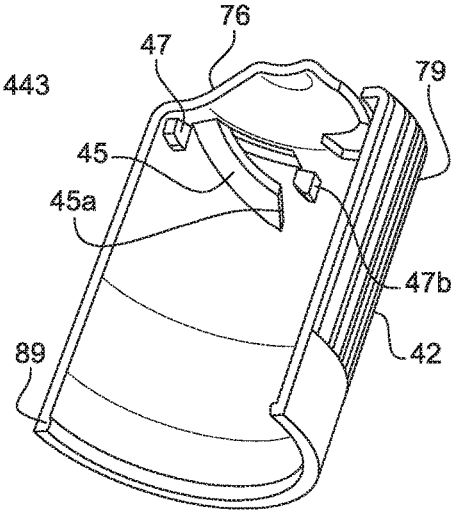
FIG. 19 is a sectional perspective view of the interior of the exterior envelope of the nozzle from FIG. 18.

As can be seen in FIG. 19, the exterior envelope 42 comprises a bottom 76 and a peripheral wall 79 of substantially cylindrical shape. The bottom 76 is of circular shape and comprises screwing projections 45, three of them for example, extending from the bottom 76. The screwing projection 45 here takes the form of flexible tongues 45 connected to the bottom 76 by their shorter side. A flexible tongue 45 is therefore able to flex about that shorter side. Its opposite side has a free end forming a lateral screwing abutment 45*a*. The bottom 76 further comprises unscrewing projections 47 arranged on the periphery of the bottom 76, each unscrewing projection 47 including a lateral unscrewing abutment 47*b*. The bottom 76 also comprises air passage orifices 82, each being in the vicinity of a flexible tongue 45. The exterior envelope 42 further comprises a rim 89 at its proximal end (P).

In this embodiment, the nozzle 10 comprises blocking mean 400 comprising a ring 410 the internal surface of which defines a sealing surface. The ring 410 is carried by the second part 442 of the interior envelope 44 and the base of the ring 410 coincides with the bottom 444 of the second part 442.

The assembly and the operation of the nozzle 10 according to this fourth embodiment are described next.

The second part 442 of the interior envelope 44 is first mounted on the first part 441 of the interior envelope 44 by positioning the fixing abutments 70 of the first part 441 of the interior element 44 along the complementary fixing abutments 87 of the second art 442 of the interior envelope 44 so that the complementary fixing abutments 87 are positioned facing the bottom of the guide slopes 67*d*. The ring 410 of the blocking means 400 is mounted on the second skirt 59 of the first part of the interior envelope 44 with a tight fit. Thereafter, the exterior envelope 42 is mounted on the interior envelope 44, the flexible tongues 45 bearing against the branches 445 or the bottom 444 and the rim 89 of the exterior envelope 42 bearing against the upper rim 73*a* of the first part 441 of the interior envelope 44 so that the exterior and interior envelopes 42, 44 are fastened together in the axial direction (A) in the storage configuration, as can be seen in FIG. 21. The cap 16 is therefore ready to be mounted by screwing it onto the rest of the nozzle 10. Once the reservoir 12 has been filled with the liquid to be dispensed, the nozzle 10, comprising the cap 16, is mounted on the neck of the reservoir 12, for example by screwing it on, clipping it on or by any other known technique. The nozzle 10 is ready to be used.

The storage configuration of the nozzle 10 is represented in FIG. 21. The two sealing surfaces defined by the second skirt 59 and by the internal surface of the ring 410 of the blocking means 400 are in fluid-tight contact with one another with the result that there is no communication between the air passage orifices 62 of the interior envelope 44 and the air passage orifices 82 of the exterior envelope 42. The orifices 62 of the interior envelope 44 are blocked by the blocking means 400. The blocking means 400 are therefore in the blocking position in this storage configuration.

The user, preferably an adult, can open the cap 16 by applying thereto a bearing force with an intensity greater than a predetermined threshold. The cap 16 is then in the unscrewing configuration. On first use, the user unscrews the cap 16. They grip the exterior envelope 42 in one hand and the reservoir 12 in the other hand. They press, axially in this example, on the exterior envelope 42 against the return force of the flexible tongues 45. The exterior envelope 42 then moves in the axial direction (A) toward the interior envelope 44 and the unscrewing projections 47 are positioned at the same level as the bottom 444. At the same time they turn the exterior envelope 42 relative to the interior envelope 44 in the first direction 1 that corresponds to the anticlockwise direction, as can be seen in FIG. 23. The lateral unscrewing abutments 47*b* carried by the unscrewing projections 47 are then caused to abut against the unscrewing surfaces 46. The second part 442 of the interior envelope 44 together with the blocking means 400 carried by that envelope 44 are driven in rotation in the same first direction 1. Simultaneously, each complementary fixing abutment 87 is guided by the guide slopes 67*d* and the rotation movement applied by the user to the exterior envelope 42 generates movement in longitudinal translation of the second part 442 of the interior envelope 44 relative to its first part 441. Arriving at the end of the guide slopes 67*d*, the complementary fixing abutments 87 come to abut on one end of the elastic lugs 66. Moreover, during this rotation the fixing detents 84 of the second part 442 are moved relative to the elastic lugs 66, over which they are forced, at the end of rotation, by deformation of the lugs 66, so that the fixing detents 84 abut against the other end of the elastic lugs 66. In this way, the second part 442 of the interior envelope 44 is locked in this position relative to the first part 441 of the interior envelope 44. The blocking means 400, being fastened to the second part 442 of the interior envelope 44, are then moved away from the first part 441 of the interior envelope and the ring 410 is placed just at the level of the cylindrical surface 60*d* and is no longer in fluid-tight contact with the second skirt 59. The blocking means 400 therefore pass from the blocking position to the opening position by movement in rotation of the blocking means 400 relative to the interior envelope 44 in the first direction 1.

After the first opening of the nozzle 10, the sealing surfaces are no longer in fluid-tight contact with one another. The exterior and interior envelopes 42, 44 include air passage orifices 62, 82 enabling a residual liquid evaporation path to be created between the opening 22 and the exterior of the nozzle 10. The residual liquid evaporation path is blocked in the storage configuration and open in the safety and unscrewing configuration.

In this configuration, once the blocking means 400 are locked in the blocking position, the first part 441 and the second part 442 of the interior envelope 44 are fastened together and the exterior envelope 42 can drive the interior envelope 44 in rotation in both first and second directions 1, 2. Gripping ribs 78 are disposed on the external periphery of the exterior envelope 42 in order to facilitate the transmission of the bearing and rotation forces.

It is clear that if the user continues the rotation movement of the cap 16 relative to the reservoir 12 in order to unscrew the cap 16 completely from the dispensing part 14 they will break the frangible parts of the ring 74. This ring 74 therefore provides a simple way to verify that the nozzle 10 has not been opened previously. The upper rim 73*a* of the interior envelope 44 is configured to prevent the exterior envelope 42 from being detached completely from the interior envelope 44.

According to an alternative to the frangible ring 74, the cap 16 may comprise other indication means that the cap is in a configuration other than the storage configuration, that is to say that the cap 16 has already been opened once. For example, the first part 441 of the interior envelope 44 comprises two zones with different colours and the second part 442 of the interior envelope 44 comprises a slot designed to show one of the colour zones as a function of the configuration of the nozzle 10. The exterior envelope 42 also comprises one or more slots enabling viewing of the colour shown in the slot carried by the second part 442 of the interior envelope 44. The cap 16 according to this embodiment is simpler and less costly to manufacture. It is therefore feasible to replace the frangible ring 74 described above by the combination of the marker surface and the reference surface. It is equally possible to combine the two embodiments to render the indication to the user of opening of the cap 16 simpler and more reliable.

Thereafter, if the user, for example a child, merely turns the exterior envelope 42 in the first direction 1 without pressing axially sufficiently strongly on the bottom 76, the cap 16 returns to the safety configuration. In fact, the flexible blades enable the exterior envelope 42 to be moved away from the interior envelope 44 so that the unscrewing projections 47 cannot come into contact with the branches 445, as can be seen in FIG. 22. The flexible tongues 45 slide on the sliding surfaces 49 carried by the branches 445 and are compressed onto those surfaces. When the flexible blades 38 are no longer in contact with the branches 445 they expand as far as the bottom 444 of the second part 442 of the interior envelope 44. In this way, rotation of the exterior envelope 42 in the first direction generates sliding of the flexible tongues 45 on each successive sliding surface 49 so as to freewheel relative to the interior envelope 44. In this safety configuration the flexible tongues 45 are moved from one branch 445 to another intermittently. The branches 445, which are spaced from one another, therefore form a discontinuous cam path and the passage of the branch 445 over the discontinuity in the cam path generates a tactile or even audible indication.

Between two uses, the user screws the cap 16 back onto the dispensing part 14. It suffices merely to turn the exterior envelope 42 in a second direction 2 corresponding to the clockwise direction without exerting a specific bearing force. Each lateral screwing abutment 45*a* carried by the flexible tongue 45 then abuts against the branch 445. The exterior and interior envelopes 42, 44 are therefore connected in movement in rotation in the second direction 2 and the cap 16 can be screwed back on.

Once the blocking means 400 are back in the opening position, they can no longer return to the blocking position. It is therefore clear that it is possible to pass from the storage configuration of the nozzle 10 to the safety or unscrewing configuration but that the converse is not possible. It is therefore guaranteed that once the nozzle 10 has been opened at least once the residual liquid evaporation path is always open.

In each of the embodiments referred to, the cap 16 may comprise a protuberance 40 (see FIG. 4) designed to be in the immediate vicinity of and facing the opening 22 when the cap 16 is mounted on the nozzle 10, this protuberance 40 having a residual liquid expulsion shape configured to evacuate residual liquid to the exterior when the cap 16 is mounted on the nozzle 10. The cap 16 may instead or additionally also comprise a residual liquid absorbing pad 48 fixed to the cap 16 and more particularly to the interior envelope 44. The pad 48 may be of substantially annular shape or in the form of a solid disk. It may be disposed around the residual liquid expulsion shape. Examples of an expulsion shape 40 and a pad 48 together with the mounting thereof in the cap 16 are described in the application WO2013/140069.

The cap 16 may include on the outside of the exterior envelope 42 at the level of the bottom 76 raised or visual means indicating to the user how to pass from the safety configuration to the unscrewing configuration. Those means may comprise a first arrow with the digit "1" indicating that the first step for opening the cap 16 is to press the exterior envelope 42 axially toward the reservoir 12 and a second arrow with the digit "2" indicating that the second step for opening the cap 16 is to turn the exterior envelope 42 in the first direction 1 relative to the reservoir 12.

The invention is not limited to the embodiments described. In particular, it will be clear that the functionalities of the various embodiments may easily be combined or separated. Moreover, an absorbent pad 48 may be provided on its own, without necessarily providing on the interior envelope 44 a protuberance having an expulsion shape. Moreover, it is clear that the structural shapes of the means described may readily vary whilst fulfilling the functions such as those described.

What is claimed is:

1. A liquid dispensing nozzle, characterized in that it comprises:

a liquid dispensing opening, a removable cap designed to cover said opening when it is mounted on the nozzle, a residual liquid evaporation path disposed between the opening and the exterior of the nozzle when the removable cap is mounted on the nozzle, a blocking part for blocking the evaporation path, mobile in the cap between a blocking position and a position opening the evaporation path, the cap comprising an exterior envelope and an interior envelope that are coaxial, mounted to be mobile relative to one another in an axial direction of the nozzle between:

a configuration before first use, termed storage configuration, in which the blocking means are in the blocking position;

a configuration for unscrewing the cap when a bearing force exerted on the cap has an intensity greater than a predetermined threshold, in which rotation in a first direction of the exterior envelope drives rotation of the interior envelope in the same first direction, so as to be able to unscrew the cap;

a safety configuration if a bearing force exerted on the cap has an intensity lower than the predetermined threshold or if no bearing force is exerted on the cap, in which the exterior envelope is configured to freewheel relative to the interior envelope in the first direction, the safety configuration further corresponding to a configuration in which the blocking means are in the opening position;

the blocking part being configured to be driven by the relative movement between the exterior envelope and the rest of the nozzle in order to pass from the blocking position to the opening position.

2. The nozzle according to claim 1, in which the blocking part are arranged between the exterior envelope and the interior envelope, the blocking part and the interior envelope each having a sealing surface and the sealing surfaces being in fluid-tight contact with one another when the blocking part are in the blocking position.

3. The nozzle according to claim 2, in which the blocking part pass from the blocking position to the opening position by movement of the blocking part relative to the interior envelope in the axial direction.

4. The nozzle according to claim 1, in which the blocking part pass from the blocking position to the opening position by rotation of the blocking part relative to the interior envelope in the first direction.

5. The nozzle according to claim 1, in which the interior envelope comprises at least one air passage orifice, that air passage orifice being blocked by the blocking part when in the blocking position.

6. The nozzle according to claim 5, in which the blocking part comprises at least one air passage orifice that is positioned facing the air passage orifice of the interior envelope only when the blocking part are in the opening position.

7. The nozzle according to claim 1, in which the exterior envelope comprises a screwing projection cooperating:

in a configuration for screwing on the cap with a screwing abutment carried by the interior envelope so that the interior envelope and the exterior envelope are connected in a rotation movement in a second direction opposite the first direction, in the safety configuration, with a sliding surface carried by the interior envelope, so that rotation of the exterior envelope in the first direction generates sliding of the screwing projection on the sliding surface so as to turn freely relative to the interior envelope.

8. The nozzle according to claim 7, in which the sliding surface and the screwing abutment carried by the interior envelope together form a detent so as to generate a tactile and/or audible indication on the passage of the detent past the screwing projection in the safety configuration.

9. The nozzle according to claim 1, the exterior envelope comprising a projection for unscrewing the interior envelope, and the interior envelope comprising an unscrewing surface designed to cooperate with the unscrewing projection so that:

in the safety configuration, rotation of the exterior envelope (42) in the first direction generates relative movement of the unscrewing projection relative to the unscrewing surface so that the exterior envelope turns freely relative to the interior envelope, in the unscrewing configuration, rotation of the exterior envelope in the first direction generates, by friction or by the unscrewing projection abutting on the unscrewing surface (19, 26, 36, 46), driving of the interior envelope in the first direction so as to unscrew the cap.

10. The nozzle according to the claim 9, in which the cap comprises a return part designed to separate the unscrewing projection and the unscrewing surface if a bearing force exerted on the cap has an intensity less than the predetermined threshold or if no bearing force is exerted on the cap, the return part comprising for example a flexible tongue or a conical circular skirt projecting from the interior surface of the exterior envelope.

11. The nozzle according to claim 1, in which the cap comprises a residual liquid absorbing pad disposed in the vicinity of the liquid dispensing opening.

12. The nozzle according to claim 1, in which the cap comprises a protuberance designed to be in the immediate vicinity of and facing the opening when the cap is mounted on the nozzle, that protuberance having a shape for expulsion of the residual liquid, configured to evacuate the residual liquid to the exterior when the cap is mounted on the nozzle.

13. The nozzle according to claim 1, in which the cap has on the outside of the exterior envelope a raised or visual part indicating to the user how to pass from the safety configuration to the unscrewing configuration.

14. The liquid dispensing device including a liquid dispensing nozzle mounted on a reservoir, characterized in that it comprises a nozzle according to claim 1.

15. The nozzle according to claim 1, in which the interior envelope comprises at least one air passage orifice, that air passage orifice being blocked by the blocking part when in the blocking position, wherein the blocking part is assembled to the interior envelope by tight assembly of the blocking part to the interior envelope or by clipping of the blocking part to the interior envelope.

* * * * *